United States Patent [19]

Lindenmeier et al.

[11] Patent Number: 5,029,308

[45] Date of Patent: Jul. 2, 1991

[54] UNIPOLAR ANTENNA WITH CONDUCTIVE FRAME

[75] Inventors: Heinz Lindenmeier, Planegg; Jochen Hopf, Haar; Leopold Reiter, Gilching; Gerhard Flachenecker, Ottobrunn, all of Fed. Rep. of Germany

[73] Assignee: Hans Kolbe & Co. Nachrichtenübertragungstechnik, Bad Salzdetfurth, Fed. Rep. of Germany

[21] Appl. No.: 366,755

[22] Filed: Jun. 14, 1989

[30] Foreign Application Priority Data

Jun. 14, 1988 [DE] Fed. Rep. of Germany ..... 3820229

[51] Int. Cl.[5] ..... H01Q 1/02

[52] U.S. Cl. ..... 343/704; 343/713

[58] Field of Search ..... 343/704, 711, 712, 713; 219/203, 522

[56] References Cited

U.S. PATENT DOCUMENTS 4,086,595 4/1978 Cherenko et al. ..... 343/713
4,091,386 5/1978 Luedtke et al. ..... 343/713
4,155,090 5/1979 Kuroyanagi et al. ..... 343/713
4,736,206 4/1988 Sakurai et al. ..... 343/704
4,791,426 12/1988 Lindenmeier et al. ..... 343/713

*Primary Examiner*—Rolf Hille
*Assistant Examiner*—Hoanganh Le
*Attorney, Agent, or Firm*—Michael J. Striker

[57] ABSTRACT

A unipole antenna arrangement for window pane of a motor vehicle mounted in a metal frame and including a heating field assembled of a plurality of substantially horizontally directed heating conductors, is composed of two superposed sets of substantially vertically directed antenna conductors. One of the sets extends in a first region in the heating field and the corresponding antenna conductors cross at least two horizontally directed heating wires. The antenna conductors in the other set extend in a region which adjoins the marginal heating conductor and terminates by common connection conductor leading to a connection point. The crossing points of the heating conductors and the antenna conductors are interconnected by a galvanic or a capacitive coupling. The connection point of the ends of the antenna conductors in the second set is connected by connection conductor with an antenna coupling point which is located near to the metal frame of the window pane.

18 Claims, 9 Drawing Sheets

UNIPOLAR ANTENNA WITH CONDUCTIVE FRAME

BACKGROUND OF THE INVENTION

The present invention relates to an antenna for the reception of meter waves in a motor vehicle, the antenna being arranged in a window pane provided with a metallic frame to form a substantially vertically unipole in the range of the vertical section plane of the pane.

As known, with antenna structures in motor vehicle panes it is possible to receive with a satisfactory efficiency all wave bands, for example long, medium and short wave bands as well as ultrashort broadcast wave bands. An advantage of this type of antenna is the fact that due to its integration into the vehicle body the requirements specific for motor vehicles, such as mechanical rigidity, longer service life, simpler assembly and the elimination of unnecessary air turbulation are much better than a standard rod antenna.

The invention is based on a known antenna described in the German Patent Application P 2,136,759 which is very suitable for the reception of frequencies of the ultrashort wavelengths. This prior art antenna employs a unipole in a metallic frame which may be constituted for example by the metal frame of a motor vehicle window pane, whereby the unipole in this specific application is applied on the glass pane within the frame. The antenna of this kind exhibits both for horizontal polarized waves as well as for the vertically or circularly polarized waves excellent reception quality and delivers an average signal level which is almost equivalent to that delivered by a telescopic antenna as is conventionally used in the motor vehicles.

However, in the antenna according to the application P 2,136,759 the crossing of the unipole with other conductive structures on the window pane, such as for example, with heating wire structures usually present in the window panes of modern motor vehicles is not permissible. Subsequently an antenna according to the application P 2,136,759 cannot be employed in motor vehicles in which a substantial portion of the window pane surface is covered by heating wires of the pane heating arrangement.

SUMMARY OF THE INVENTION

Accordingly, it is a general object of the present invention to avoid the disadvantages of the prior art.

More particularly, it is an object of the invention to develop a vertical unipole antenna of the above described kind which can be combined with a conventional heating field having horizontal heating wires such that the antenna achieves a high sensitivity independently of the polarization of the reception field in the meter wavelength band.

In pursuance of these objects and others which will become apparent hereafter, one feature of the present invention resides in the provision of a vertical antenna conductor structure arranged in an intermediate area in the range of the vertical plane of symmetry of the window pane and including at least one, substantially vertically directed antenna conductor having a low impedance for the frequencies of the meter wave band, a first part of the antenna conductor extending in the heat field across at least two heating conductors; a second part of the antenna conductor not overlapping the heating field and terminating in a connection point; a connection conductor which leads from the connection point to an antenna terminal located near to the metal frame; another antenna terminal being connected to a ground point on the metal frame; and the crossing points of the antenna conductor with the heating conductors being interconnected at least for the frequencies of the meter wave band.

In a preferred embodiment of the invention, the antenna conductor structures includes a plurality of substantially parallel antenna conductors, a first part of the respective antenna conductors extending in a first region across at least two heating conductors, a second part of the respective antenna conductors overlapping the heating field and extending in a second region between the topmost heating conductor and a common connection point with the connection conductor; and the crossing points of the respective antenna conductors being directly interconnected or coupled by a low resistance coupling at least for the frequencies of the meter band.

The advantages of the thus constructed antenna are as follows: an excellent reception performance for the horizontally or vertically or circularly polarized waves in the meter wavelength bands, non-critical dimensioning as regards the requisite number of antenna conductors, their mutual clearance as well as the total height of the antenna structure. From the point of view of technological requirements it is of particular advantage that for the realization of the antenna conductors and the heating conductors the same technology is used whereby the two types of conductors can be applied on the glass pane in the same operational step when using either the sieve printing process or when inserting the corresponding wires between the layers of a multilayer glass pane. These advantageous aspects are the prerequisites for an extremely cost effective manufacture. When using the printed circuit technology, it is of advantage to provide a galvanic connection between the crossing points of the antenna conductors and the heating conductors inasmuch as in the galvanization process no further contacts need to be made as is the case in antennas without the galvanic coupling.

The novel features which are considered as characteristic for the invention are set forth in particular in the appended claims. The improved unipole receiving antenna itself, however, both as to its construction and its utilization, together with additional features and advantages thereof, will be best understood upon perusal of the following detailed description of certain specific embodiments with reference to the accompanying drawing.

DESCRIPTION OF THE PREFERRED EMBODIMENTS

Figure 1:
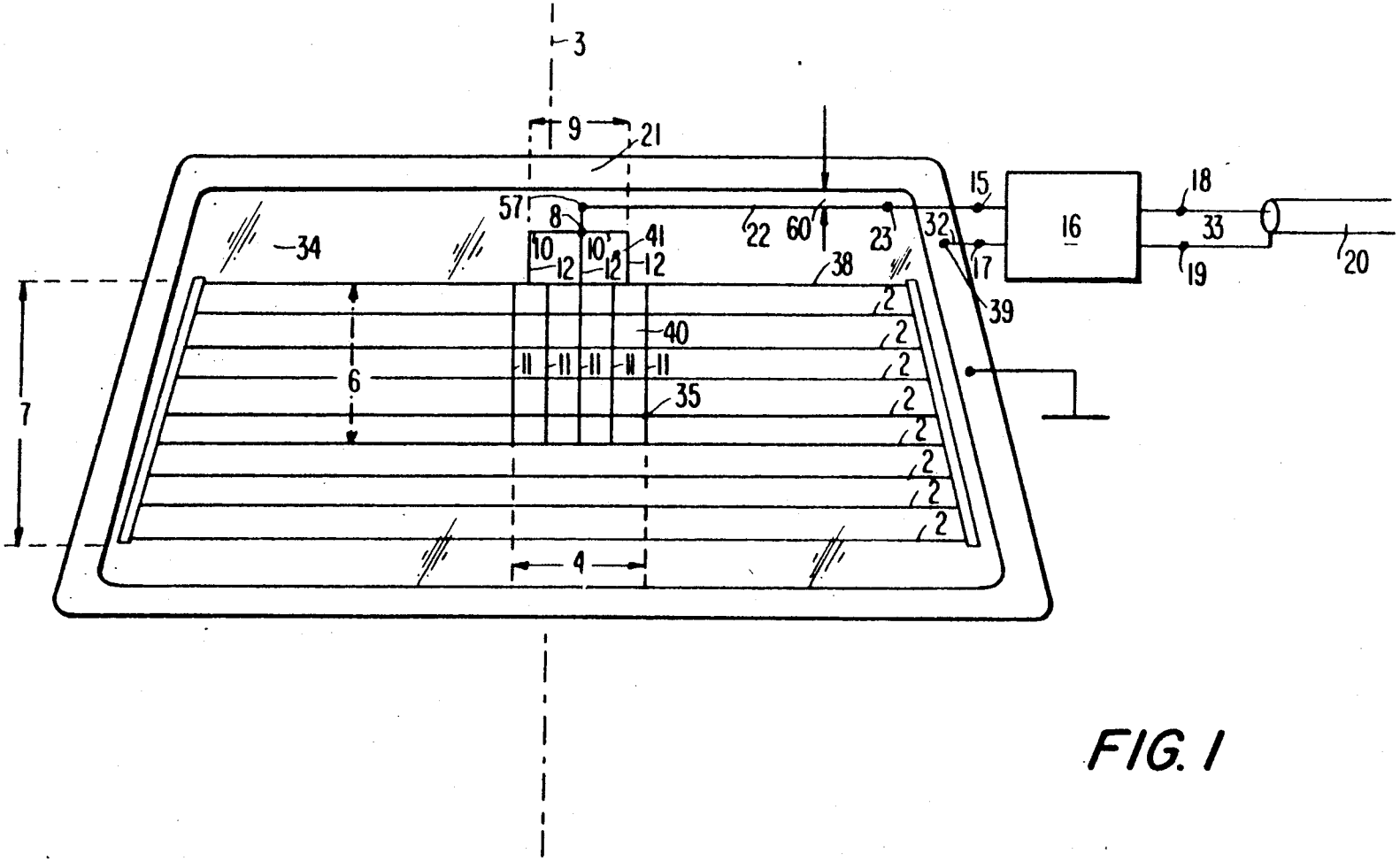
FIG. 1 shows an antenna according to this invention having five vertical antenna conductors in the first region and three vertical antenna conductors in the second region, the conductors being arranged non-symmetrically relative to the vertical section plane of the pane and having a connection conductor leading to the antenna terminal which is spaced a small distance from the upper side of the pane frame.

FIG. 1 illustrates a basic arrangement of an antenna according to the invention. A metal frame 21 which schematically represents the body of a motor vehicle, surrounds a window pane 34 of the motor vehicle upon which a heating structure consisting of horizontal heating conductors 2 is arranged. The topmost heating conductor separating a first region 40 from the second region 41 of the antenna is indicated by reference numeral 38. The remaining heating conductors are indicated by reference numeral 2. In modern motor vehicles the horizontal heating conductors are either directly printed on the glass pane by a sieve printing process and subsequently reinforced by a galvanic process to achieve the low resistance value required for the heating purposes, or in multilayer window panes the horizontal heating conductors are usually in the form of tungsten wires sandwiched between the layers of the window pane.

In both instances the heating conductors 2 and 38 have a wire-like configuration. As a rule, the surface area covered by the heating field is relatively large so that above and below the heating field only relatively narrow strips of unused free pane surface remain and restricted dimensions of these free strips do not permit the realization of an antenna for a meter wavelength range having a comparable reception quality with that of the antenna according to the German application P 2,136,759.

In the embodiment of the antenna according to this invention shown in FIG. 1, the vertical antenna conductors 11 extend over the horizontal heating conductors 2 and 38 in the first region 40 having a horizontal dimension 4 and a vertical dimension 6. The reference numeral 7 denotes the vertical dimension of the entire heating field. Among other characteristic features, it is essential for the antenna of this invention that in the first region 40 the crossing points 35 of the horizontal heating conductors 2, 38 and the vertical antenna conductors 11 have a galvanic or direct electrical connection.

In the case of a heating field in which the horizontal heating conductors 2, 38 and the vertical antenna conductors 11 are applied on the glass pane by a printing process, the galvanic interconnection of the crossing points results automatically and represents a necessary condition for a cost effective production because the provision of mutually isolated crossing of printed conductors would be technologically substantially more difficult to realize.

In the case of a multilayer window pane, the galvanic contact between the crossing heating conductors 2, 38 and antenna conductors 11, 12, 10 and 22 is achieved when these two types of conductors are first prearranged on the same side of a foil of plastic material which is subsequently sandwiched between the glass sheets of the composite window pane and subsequently glues the sheets together by the exposition to a high temperature. With this process it is not unconditionally necessary that a galvanic connection is created at every crossing point because the clearance between the heating conductors in the composite panes is so small (about 5 mm) that a substantially greater number of crossing points is present and even without galvanic contacts between the crossing conductors a capacity coupling exists which for the high frequencies of the meter wavelength range has such a low impedance as to provide electrically the same effect.

For the selection of the structure of the antenna conductors there occur hardly any limitations from a manufacturing point of view. It is possible to produce complex conductor structures with variable cross-sections and thus changing resistances by a corresponding printing sieve without any additional costs in the same working process in which the heating conductors are printed. However, there are restrictions as regards the minimum width of the conductors which can be realized without the risk of interruption. For this reason the printed on wire structures are visible and consequently optically conspicuous. An essential aspect for the selection of the arrangement of the antenna conductors is therefore the consideration of style which implies not to use an unnecessary number of antenna conductors in the antenna of this invention.

In the composite glass pane, very thin tungsten wires or copper wires are inserted between the individual glass layers to serve as the heating conductors and antenna conductors and these wires are almost invisible. Consequently in the selection of the antenna conductor arrangement in the composite panes stylistic aspects are substantially less important than in the case of printed conductors. On the other hand, the number of conductors in the composite glass pane increases manufacturing costs because each conductor in the antenna structure must be applied on the plastic intermediate sheet individually. For this reason also in the case of composite panes it is desirable to employ minimum number of antenna conductors and to achieve a clear arrangement of the antenna of the invention.

From the heating point of view of the glass pane the vertical antenna conductors 11 represent undesired electric shunts through which compensation currents between the individual horizontal heating conductors 2 tend to flow and consequently the defrosting quality of the heating fields for the pane is changed in an undersired manner. In the antenna according to this invention, this undesired effect is avoided by arranging the antenna conductors 11 along equipotential lines 37 with respect to the direct current voltages on the heating field so that the individual vertical antenna conductors 11 cross the points of the same potential on the horizontal heating conductors and no equalizing currents go through the antenna conductors 11 (FIG. 2).

Figure 2:
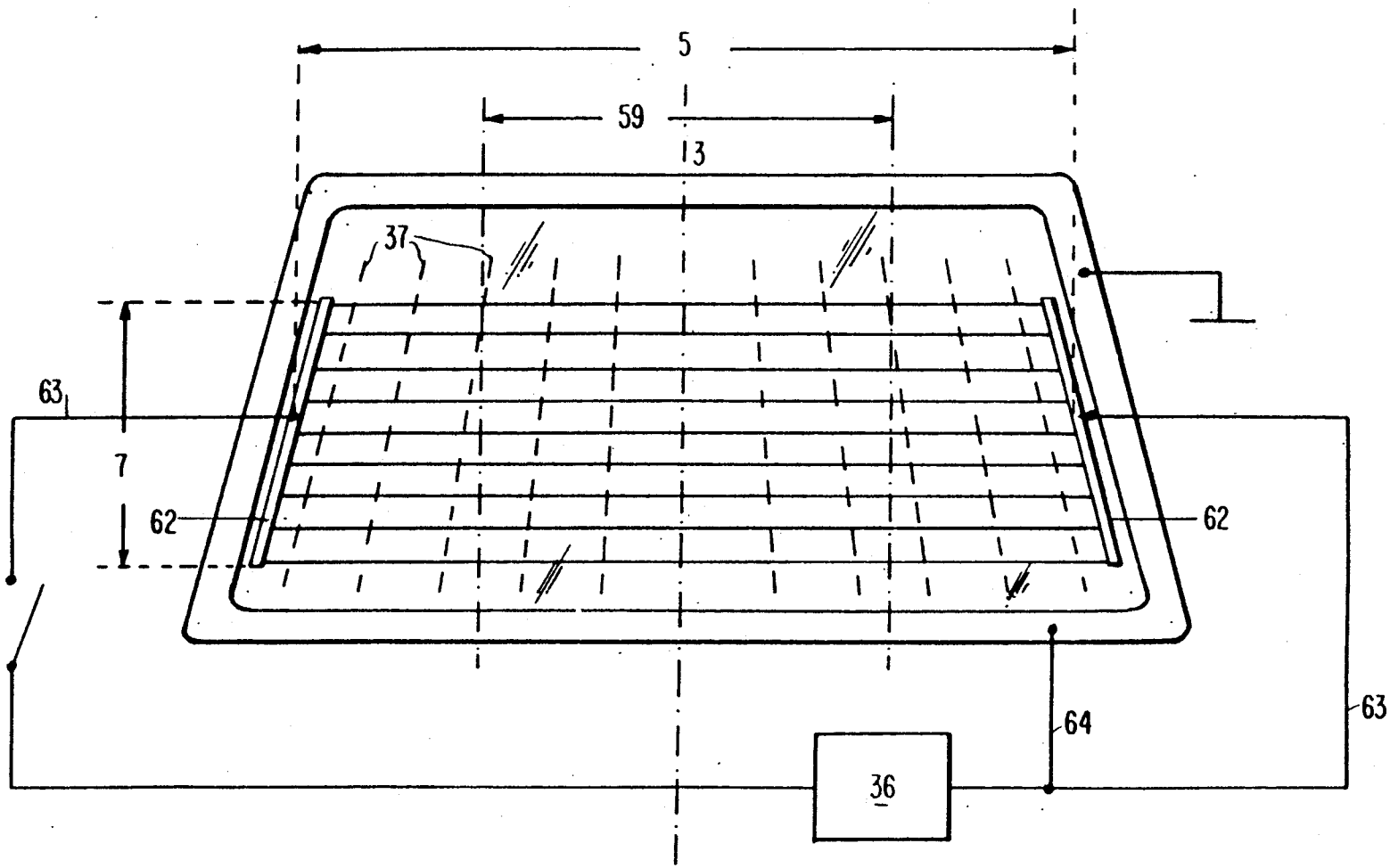
FIG. 2 shows lines of equal potential in a heating field of a window pane and indicates the range in which the antenna conductors are to be arranged.

In the example of FIG. 2 it is evident that the line of symmetry 3 of the window pane represents also an equipotential line along which the corresponding points on respective heating conductors have exactly half the voltage of the car battery 36 against grounded frame 21 when the heating is turned on. In reality, the equipotential lines 37 are not exactly parallel relative to each other whereby the deviation from the parallel course relative to the equipotential line passing through the center of the glass pane increases in a direction toward the lateral side of the pane frame. This deviation is the higher the more differs the trapezoidal form of the window frame from a rectangle. Consequently, if the vertical antenna conductors 11 are arranged in a sufficiently narrow area with respect to the vertical line of symmetry 3 of the window pane then the equipotential lines 37 approximate very closely the parallel course. As a result, the antenna conductors 11 fairly approximate the parallel arrangement of the equipotential lines 37.

The top ends of respective vertical antenna conductors 11 in the antenna according to the invention are galvanically i.e., directly connected with the topmost horizontal heating conductor 38. Therefore, the first region 40 of the antenna immediately joins the second region 41. Below the topmost horizontal heating conductor 38 each of the antenna conductors 11 crosses at least one intermediate heating conductor 2. In the example of FIG. 1, the antenna conductors cross six horizontal heating conductors 38 and 2 of their total number number of nine.

The number of vertical conductors 12 in the second region 41 can in principle differ from the number of antenna conductors 11 in the first region 40 as seen from FIG. 1 where only three antenna conductors 12 are present. The antenna conductors 12 start at the topmost heating conductor 38 forming the top edge of the heating field and are also galvanically connected therewith. The second set of the antenna conductors 12 terminates in a horizontally extending connection conductor 10 and are electrically connected therewith or coupled thereto by a low resistance coupling for the frequencies of the meter wavelength bands.

In the embodiment according to FIG. 2, all antenna conductors 11 and 12 are arranged in a region 42 which is symmetrical relative to the vertical line of symmetry 3 of the window pane and whose width 59 amounts to half the width 5 of the average width of the window pane.

When modifying the arrangement and the number of antenna conductors 11 and 12 the evaluation of the performance of the corresponding antenna of the invention is carried out in practice by means of known statistical measuring methods assisted by computers which determine the output signal level of the antenna by means of a measuring receiver and by means of test drives through typical reception fields of the frequencies and polarization of received waves at the desired frequencies the average signal level and the level statistics of the test antenna are determined from the comparison with a reference antenna.

The measurements of this kind have shown that the antenna according to this invention after changing the arrangement and the number of antenna conductors has changed its properties in desired manner.

Figure 3:
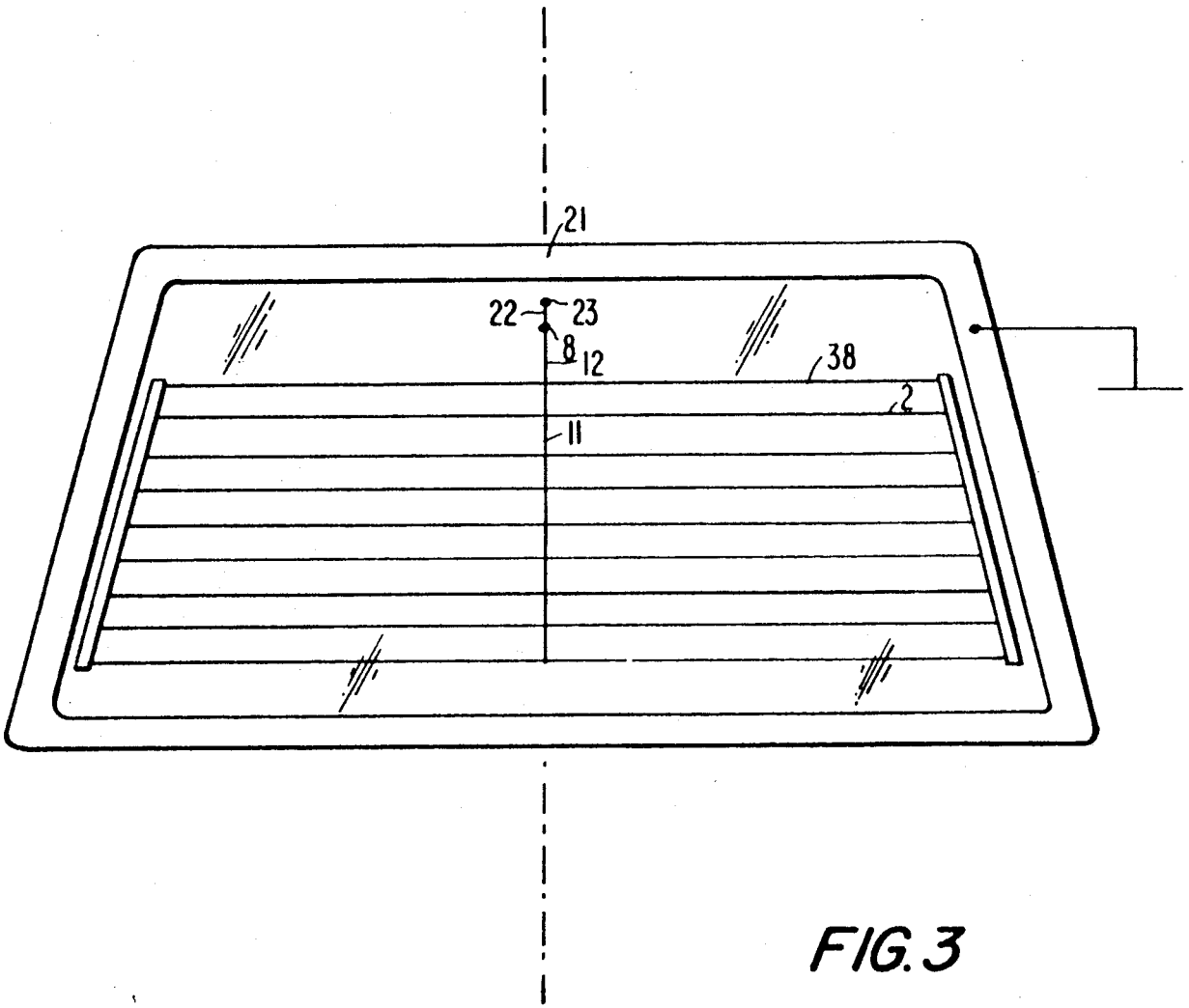
FIG. 3 shows an antenna according to the invention having only a single antenna conductor in the first and second regions and a terminal point situated on the vertical line of symmetry of the window pane in the proximity of the upper side of the metal frame.

Referring to FIG. 3, there is illustrated the simplest embodiment of the antenna of this invention having a single vertical conductor 11 in the first region 40 and a single antenna conductor 12 in the second region 41. The antenna conductors 11 and 12 in this case are integrally connected one with the other. In this special case, the connection conductor 10 coincides with the connection point 8 from which connection conductor 22 extends along the line of symmetry 3 up to the terminal point 23 located in the proximity of the top side of the metal frame. Connection conductor 22 is also integrally connected with the antenna conductor 12.

In the following the function of the exemplary embodiment of the antenna of the invention shown in FIG. 3 will be explained. As known, the opening delimited by the metal frame 21 enclosing the window pane can be perceived approximately as a slot radiator which is best excitable by rays whose electrical field strength vector is oriented in the direction of the vertical line of symmetry 3 of the pane. At frequencies at which the width of the window pane corresponds approximately to the half wavelength such as for example the center of the frequency range of the meter wavelength as is the case in contemporary personal cars, there results additionally a resonance-like increase of electrical fields in the center of the window pane. In the case of motor vehicle panes having heating field this resonance in comparison to panes without heating field is more strongly dampened and accordingly, has a broader band inasmuch as the heating conductors are unavoidably more coupled to the high frequency field within the frame and produce considerable losses in the high frequency field because the heating conductors have a considerable ohmic resistance for the direct current and with increasing frequency the electrical conductivity both of printed on conductors and of the inserted wires strongly decreases.

Both with horizontally and with vertically and circularly polarized reception fields due to the inclined position of the window pane in the vehicle body the field components in the direction of the center line of symmetry 3 are present which electrically excite the region in the window opening. The unipole which in the antenna of the invention is constituted by antenna conductors 11 and 12 is therefore strongly coupled to the reception field. The coupling is maximum when the antenna conductors are arranged in the vertical line of symmetry of the pane because due to the short circuit of the electric field by the lateral sides of the metal frame a symmetrical distribution of the electric field strength points is of necessity created with a maximum in the center of the window pane. Due to the known, in the first approximation sine-shaped characteristic of the field strength distribution the signal drawn from the unipole decreases initially only at a low rate, with increasing proximity to the edge of the window pane the signal decreases fast when the unipole is applied asymmetrically. With increasing distance of the unipole from the vertical line of symmetry of the window pane consequently the reception performance becomes impaired and therefore it is preferred in the antenna of this invention that the unipole be arranged in the center region of the window pane.

Nevertheless, it may be desirable and of advantage when the unipole is arranged asymmetrically with respect to the line of symmetry 3 of the pane. For example this may be required for stylistic reasons or when several antennas of this invention each having a different reception characteristic, for example for an antenna diversity system or for different frequency bands in the meter wavelength band are to be installed in a single motor vehicle pane. In such cases the unipole can be shifted as far as to the rim of the region 42 which as mentioned before, is symmetrical relative to the vertical line of symmetry of the pane and whose width is equal to half the average width of the pane.

Due to the galvanic connection of the crossing points of the vertical antenna conductors 11 and the heating conductors 38 and 2, the heating conductors in the antenna of this invention participate in the coupling to the electric field. With respect to its environment each of the conductors in the window pane represents conductor which has relative to conventional coaxial conductors a high wave resistance and high losses. With increasing distance from the antenna terminal point 23 therefore the decoupling rapidly increases so that the highest contribution to the reception signal originates in the close environment of the terminal point 23.

Figure 4:
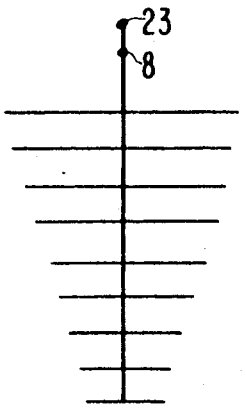
FIG. 4 is an exemplary representation of the reception zone of the unipole according to FIG. 3.

In order to clarify this property of decoupling, FIG. 4 illustrates by way of an example the effective portions of the entire conductor structure of the antenna of FIG. 3. This decoupling property which increases with the increasing distance from the terminal point 23 makes the favorable reaction of the antenna of the invention relative to the changes in the number of antenna conductors and to their geometry understandable provided that such changes are made in sufficient distance from the terminal point 23.

Figure 5:
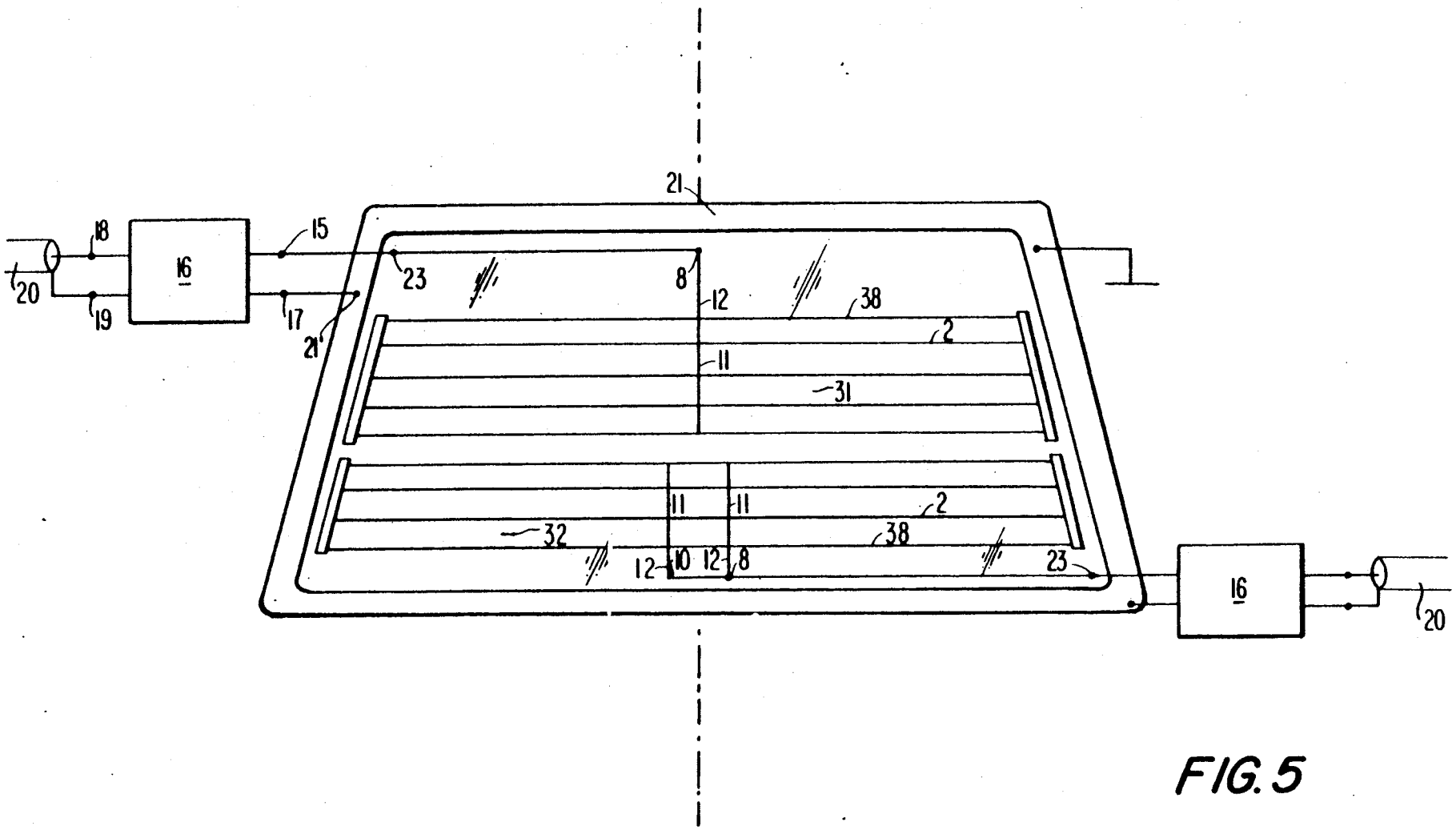
FIG. 5 is a modification of the invention showing a divided heating field provided with two antennas of this invention in a single pane.

For example, there result only minor and in practice insignificant degradation of the reception quality when the antenna conductors 11 do not extend over the entire array of nine heating conductors 2 and 38 of the heating field but extend only over part of the latter, for example, over five heating conductors only as illustrated in the example of FIG. 5. The good reception performance of an antenna of this invention remains substantially preserved as long as at least two heating conductors are crossed. Preferably, the antenna conductors extend over more than two heating conductors because as a rule the increasing number of crossing points has the tendency to improve the reception quality without introducing any disadvantages.

Although from the stylistic aspects it is preferred to select the length 6 of the antenna conductors 11 (shown in FIG. 3) as large as is the height 7 of the heating field provided that it is not desired to install additional independent antennas on the window pane surface.

Another advantageous embodiment of the antenna of this invention includes two or more antenna conductors 11 and 12 in the first and second regions 40 and 41. In this manner, the zone which is effective for the reception can be broadened as it will be explained in connection with FIGS. 6 and 7.

Figure 6:
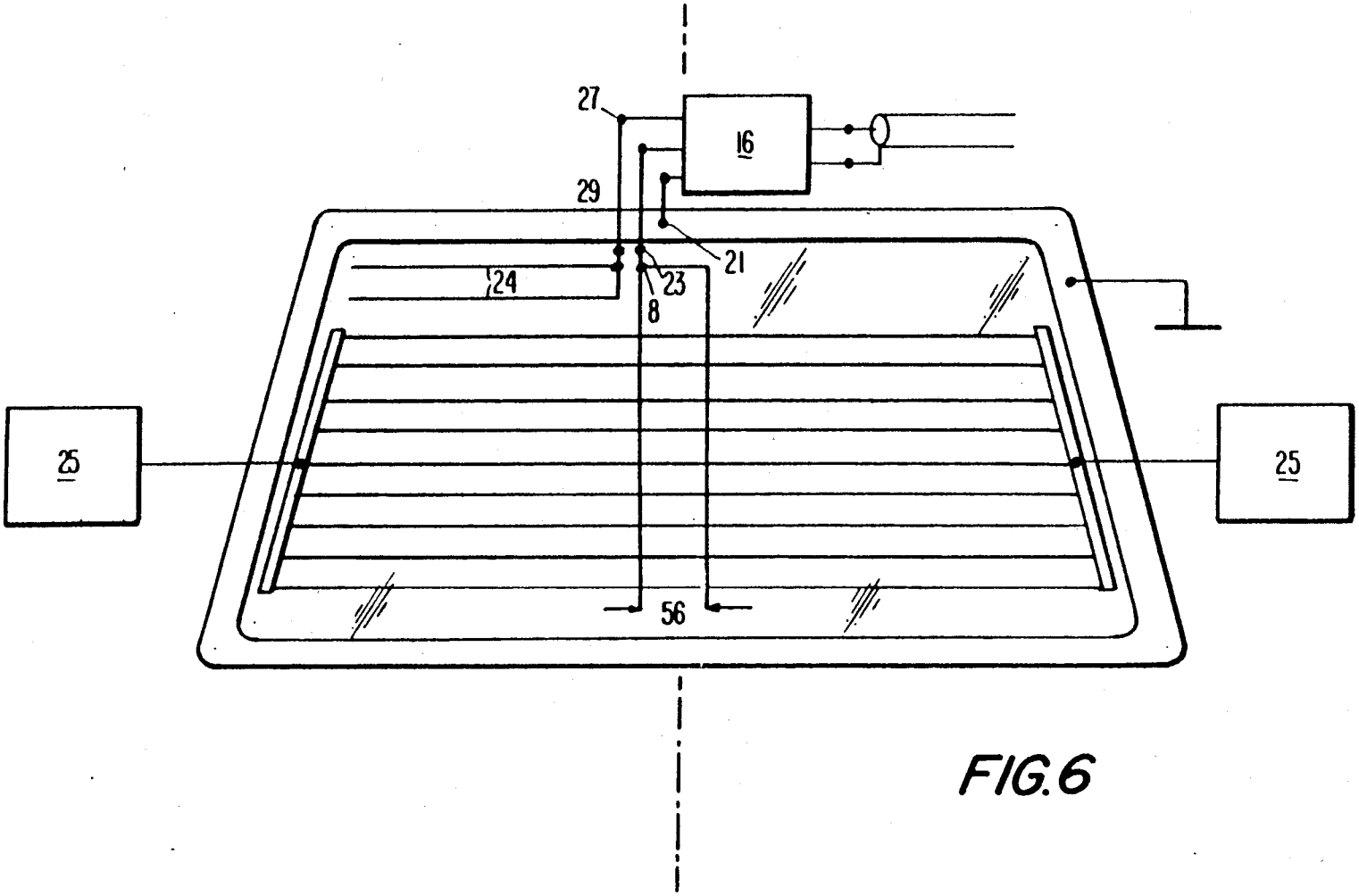
FIG. 6 shows an embodiment of an antenna of the invention having two vertical antenna conductors and a separate long-medium-short wave reception structure.

In FIG. 6, two antenna conductors 11 and 12 are arranged in the first and second regions almost parallel one to another whereby for optical reasons the antenna conductors 11 and 12 immediately transit one into the other. The clearance 56 between the two sets of antenna conductors is preferably in the range between 1/30 and 1/10 of the average wavelength in desired meter wave length band.

Figure 7:
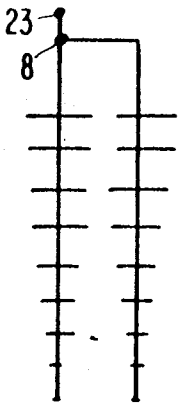
FIG. 7 is an exemplary representation of the preferred reception zone of the unipole of FIG. 6.

FIG. 7 shows the portions of the unipole conductor structure according to FIG. 6 which serve most effectively for the reception of the signal.

When the spacing 56 is selected between 1/30 and 1/10 of the operative wavelength, then particularly efficient broadening of the reception zone results.

If the spacing 56 is selected smaller than the above mentioned range, then the effect on reception is almost identical with an antenna having a single antenna conductor; if the distance 56 is selected larger than the first mentioned preferred distance, no additional advantage is achieved. If the width 4 or 9 of the first region of the unipole is larger than 1/10 of the operating wavelength, it is recommended to employ additional antenna conductors.

Due to the broader reception zone in the structure of FIG. 6 in comparison to the structure of FIG. 3, there is achieved a somewhat better reception performance. At the same time, the structure of FIG. 6 has the advantage that after an breakage of one of the two antenna conductor branches reception performance is impaired to some extent nevertheless in practice such a deterioration is hardly noticeable. In contrast to the structure of FIG. 3 if one conductor part is interrupted, especially in the conductor part 12 the reception is substantially impaired. The danger of the interruption of an antenna conductor is present particularly in window panes having printed conductors because of their exposure to mechanical damage.

The use of more than two antenna conductors 11 and 12 in the antenna of this invention is in no case detrimental nevertheless due to the above discussed decoupling their effect on the reception performance is the smaller the more remote are the newly introduced antenna conductors from the terminal point 23. Therefore, as an upper limit for the area occupied by the unipole of the invention is the region 42 in FIG. 2 within which the antenna conductors 11 and 12 are arranged. As mentioned before, the low ohmic resistance connection of the antenna conductors 12 to the horizontally directed connection conductor 10 is effected by galvanic or direct current connections.

Such a galvanic connection to the conductor path creates a shunt for the heating current flowing through the antenna conductors 12 and the topmost heating conductor 38 which is most influenced by the connection conductor 10 due to its spatial proximity. The current distribution in the topmost heating conductor 38 will be explained with reference to FIG. 8 which illustrates a section of the antenna structure of FIG. 1 in the region of the vertical sectional plane around the topmost heating conductor 38.

Figure 8:
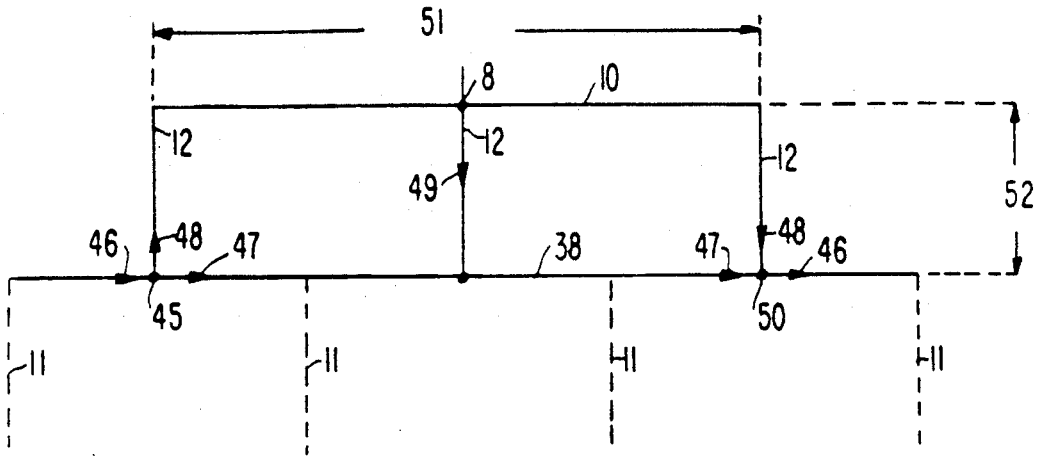
FIG. 8 shows a detail of FIG. 6 to illustrate the distribution of heating currents in the marginal heating conductor.
Figure 9:
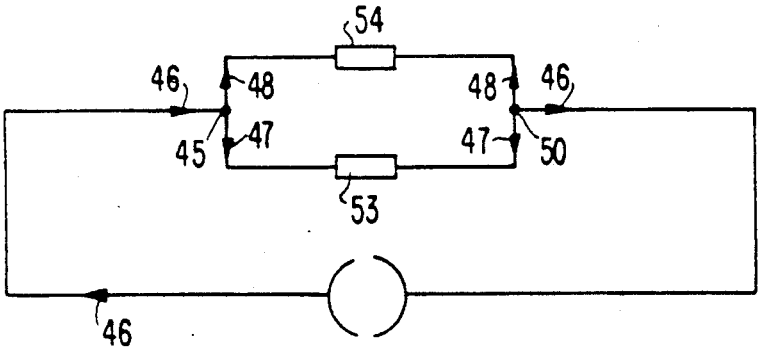
FIGS. 9 and 10 show substitute circuit diagrams of the detail of FIG. 8.
Figure 10:
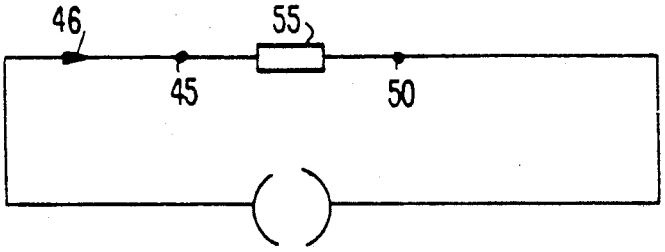

At the branching point 45 the heating current 46 is divided into components 47 and 48 whose ratio as known is determined by ohmic resistances 53 and 54 (FIG. 9) of the two branches between branching point 45 and the junction point 50. FIG. 9 illustrates an equivalent simplified or substitute circuit diagram of the circuit of FIG. 8. With an equal specific conductivity of antenna conductors 12 and heating conductors 38 each partial resistance of respective branches between the points 45 and 50 is in a fixed proportion. Due to the fact that in the vertical line of symmetry of the antenna structure an equipotential line extends the current 49 in FIG. 8 is substantially zero and therefore need not be further considered.

In the following the effect of the length of the branch path on the ratio of currents 47 and 48 and on the heating output between the points 45 and 50 will be considered. For the sake of simplicity the geometry of FIG. 8 wherein the antenna conductors 12 extend exactly parallel to each other and are exactly of the same length, will be considered so that joining or connection conductor 10 has the same length as the spacing between the points 45 and 50. In the arrangement illustrated in FIG. 8 under the above mentioned assumptions a difference in the current path of the two branches will result corresponding to the double length 52 of an antenna conductor 12. In addition it must be assumed that the introduction of the current path via the antenna conductor 12 and the connection antenna conductor 10 does not change the value of the total current 46. The following considerations are valid also for the geometric arrangement of the partial circuit.

For an extremely small length 52 of the antenna conductor 12, that is for the case when the topmost heating conductor 38 immediately adjoins the connecting conductor 10, the two ohmic resistances 53 and 54 are of equal magnitude and so are the two branch currents 47 and 48. The total resistance between the points 45 and 50 is therefore half the magnitude of a resistor which would become effective in the absence of the antenna conductors 12 and of the reconducted connection conductors 10 provided that no cross-section matching of the two conductors in the range under consideration is made. The heating of the window pane portion between the points 45 and 50 at the minute clearance between the antenna conductors 12 and the connection conductors 10 would be only half the magnitude of the heating when the antenna conductors 12 and the connection conductors 10 be absent because of the proportionality of the converted effective power to the total resistance 55 which corresponds to the parallel connected resistance 53 and 54. Consequently in such a construction of the antenna according to the invention a defrosting action in the region between the points 45 and 50 occurs which deviates from that in the remaining part of the heating field. Therefore, it is more advantageous for the antenna of the invention to reduce by half the cross-section of the heating conductor 38 and of the connection conductor 10 between the points 45 and 50. This measure in sieve printing process is easily accomplished by a corresponding adjustment on the printing sieve.

If the length 52 of the antenna conductors 12 is not small enough for heating the window pane section between the points 45 and 50 as if by a single heating conductor only, then the interactions become more complicated. As a rule, it is desirable to limit the heating of the window pane section in the region about the heating conductor 38 only and consequently a dimensioning should be devised at which heat converted in the antenna conductors 12 and the connection conductor 10 remains minimum. This objective can be attained by the corresponding selection of the cross-sections of the antenna conductors 12 and of the connection conductor 10 on the one hand and of the section of the heating conductor 38 between the points 45 and 50 on the other hand.

A general analysis of a standard construction of heating wires, that is without antenna conductors 12 and connection conductor 10 between the points 45 and 50 leads to the following values of resistors 54 (R1) and 53 (R2) corresponding to the combined resistor value 55 (R) which produce the desired action of the antenna of the invention:

TABLE 1

| | | | |
|---|---|---|---|
| R1/R = 4 | R2/R = 4 | R1/R = 4.5 | R2/R = 2.6 |
| R1/R = 5 | R2/R = 2 | R1/R = 6 | R2/R = 1.6 |
| R1/R = 10 | R2/R = 1.2 | | |

According to the Table 1, an advantageous construction of the antenna of the invention for a predetermined ratio R1/R ratio R2/R is determined by the selection of a suitable cross-section of the antenna conductors 12 between the points 45 and 50, that means in the range of the width 9 of the second region of the unipole. For example, there results the same cross-section for the antenna conductors 12 and the connection conductor 10 as for the heating conductor, namely the cross-section value of R1/R=5 when the clearance between the connection conductor 10 to the topmost heating conductor 38 is two times as large as is the width 9 of the antenna structure in the second range 41. In order to convert under these circumstances the same heating power per length unit in the range of the second structural region having the width 9 as in the remaining part of the heating field then according to the Table 1 the resistance for direct current must be doubled which is preferably made by reducing the cross-section of the heating conductor by half.

Another preferred embodiment of the antenna of this invention without the adjustment of the cross-section of the conductors is made possible when in the area of glass pane between the heating conductor 38 and the upper side of the frame is so large that the length 52 of the antenna conductors 12 is large with respect to the width 9 of the second range 41 of the antenna structure. In this case the ohmic resistance 54 is large in relation to the ohmic resistance 53 and consequently the current portion 47 almost corresponds to the total current 46 and the other current portion 48 is so small that it can be neglected. Such a condition according to the Table 1 corresponds to a very high value of the ratio R1/R for which the ratio R2/2 approaches asymptotically the value "1".

For the above reasons it is advantageous for the antenna of the invention when connection conductor 10 is arranged as close to the metal frame as possible because in this manner the influencing of the direct current flow and thus of the distribution of the heating power on the window pane is most effective. For optical or appearance reasons it is also of advantage when the connection conductor 10 extends parallel to the heating conductors 2 or to the corresponding horizontal side of the metal frame.

Figure 11:
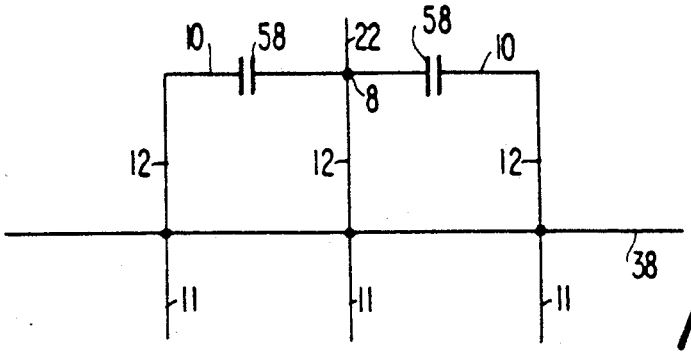
FIG. 11 shows capacity couplings serving as the common connection conductors for the individual antenna conductors to eliminate the branching of heating currents.

In a further advantageous embodiment of the antenna of this invention the above mentioned problems are avoided by substituting the galvanic connection of the antenna conductors 12 to the connection conductor 10 and to the connection point 8 with a coupling which does not pass any direct current component, nevertheless for frequencies in the meter wavelength band has a sufficiently low impedance. According to FIG. 11, such a coupling is achieved by capacitors 58 which can be for example in the form of chip capacitors soldered to the corresponding ends of the antenna conductors 12 on the window pane.

Figure 12:
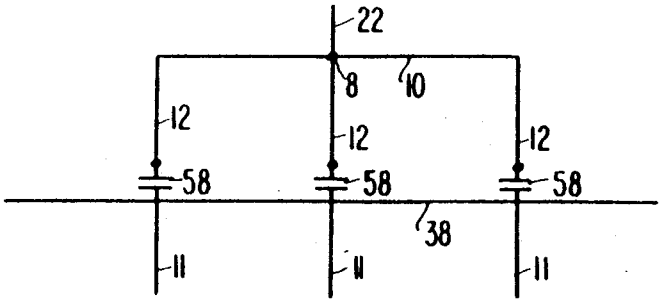
FIG. 12 shows capacity couplings arranged in the second part of antenna conductors to eliminate the branching of the heating current.

An electrically equivalent action for eliminating the direct current heating components through the antenna conductors 12 in the second region of the antenna of the invention can be also achieved by substituting the galvanic connections between the first and second regions 40 and 41 by similar capacity couplings which prevent the passage of direct current components but permit at sufficiently low resistance a passage of high frequency currents in the range of meter wavelengths. As illustrated in FIG. 12, the capacitors 58 are provided between the lower ends of antenna conductors 12 and the connection points of the antenna conductors 11 with the horizontal heating conductor 58.

In the following description the preferred embodiments of the connection conductor 22 for antennas according to the invention will be discussed.

Referring again to FIGS. 1 and 3, the common connection point 8 or the common connection conductor 10 is always located in the central range 42 of the antenna according to the invention on the window pane, that means in the range which is intersected by the vertical line of symmetry 3 of the window pane and which has a width corresponding at least to the half of the average width 5 of the window pane. For the sake of symmetry it is recommended to provide a completely symmetrical structure wherein as a rule also the connection point 8 is located on the vertical line of symmetry 3. If a connection point for an external connection network 16 is to be provided on the vertical line of symmetry 3 in proximity or on the metal frame 21 then it is necessary to provide connection between the connection point 8 and terminal point 23 which extends in the proximity of the metal frame 21. This connection is established by the connection conductor 22 which may extend preferably along the central line of symmetry (FIG. 3). If the connection point to the network is not located on the central line of symmetry 3 of the window pane then as a rule the connection point 8 is also located outside the line of symmetry 3 on the pane and for optical reasons it is advantageous to direct the connection conductor 22 parallel to the lateral sides of the metal frame or to the central line of symmetry 3.

For various reasons specific to the assembly or to the sequence of manufacturing steps or to the accessibility of component parts of the motor vehicle, the connection point for the network 16 is frequently arranged in the range of the ceiling of the motor vehicle. In this case it is necessary that reception signal available at the connection point 8 is delivered to the connection network 16 and to the proximity of the frame 21 without impairing the achieved reception output.

This objective is achieved in the antenna according to this invention by the provision of connection conductor 22 which generally consists of several interconnected partial conductors which for optical reasons are preferably connected parallel to the neighboring edge of the metal frame. A typical arrangement of the connection conductors shown for example in FIG. 1 in which the connection network 16 is arranged in the range of the left side of the frame and the connection conductor 22 starts from the connection point 8, is directed initially along the vertical line of symmetry 3 of the pane up to the proximity of the metal frame where at deviation point 57 is at right angles and redirected substantially parallel to the upper side of the frame 21 to terminate in the terminal point 23 of the antenna located in the upper right hand corner of the pane. Depending on the position of the network 16 additional bending points 57 may be necessary on the connection conductor 22.

The magnitude of the clearance 60 between the connection conductor 22 and side of the metal frame depends on requirements set for the antenna of the invention.

For example, if it is desired to design a window pane antenna whose performance comes as close as possible to a rod antenna during a polarization change then the clearance 60 must be held relatively small, that means between 1 cm to 5 cm. With this dimensioning there results-provided the excitation field strength has the same value both for horizontally polarized and for the vertically polarized waves - a considerable increase of the signal level during the transition from the horizontal polarization to the vertical or circular one. The signal level increase is of a similar magnitude as that achieved by a rod antenna mounted perpendicularly on the vehicle. This property results from the fact that the connection point 8 of the antenna of the invention is arranged most symmetrically in the center line of the window pane and due to the small distance 60 on the connection conductor 22 from the upper side of the metal frame proximates the characteristic of a transmission line which produces only negligibly small signals from the reception field. Therefore, the polarization action on the connection point 8 is substantially transmitted to the terminal point 23.

Figure 13:
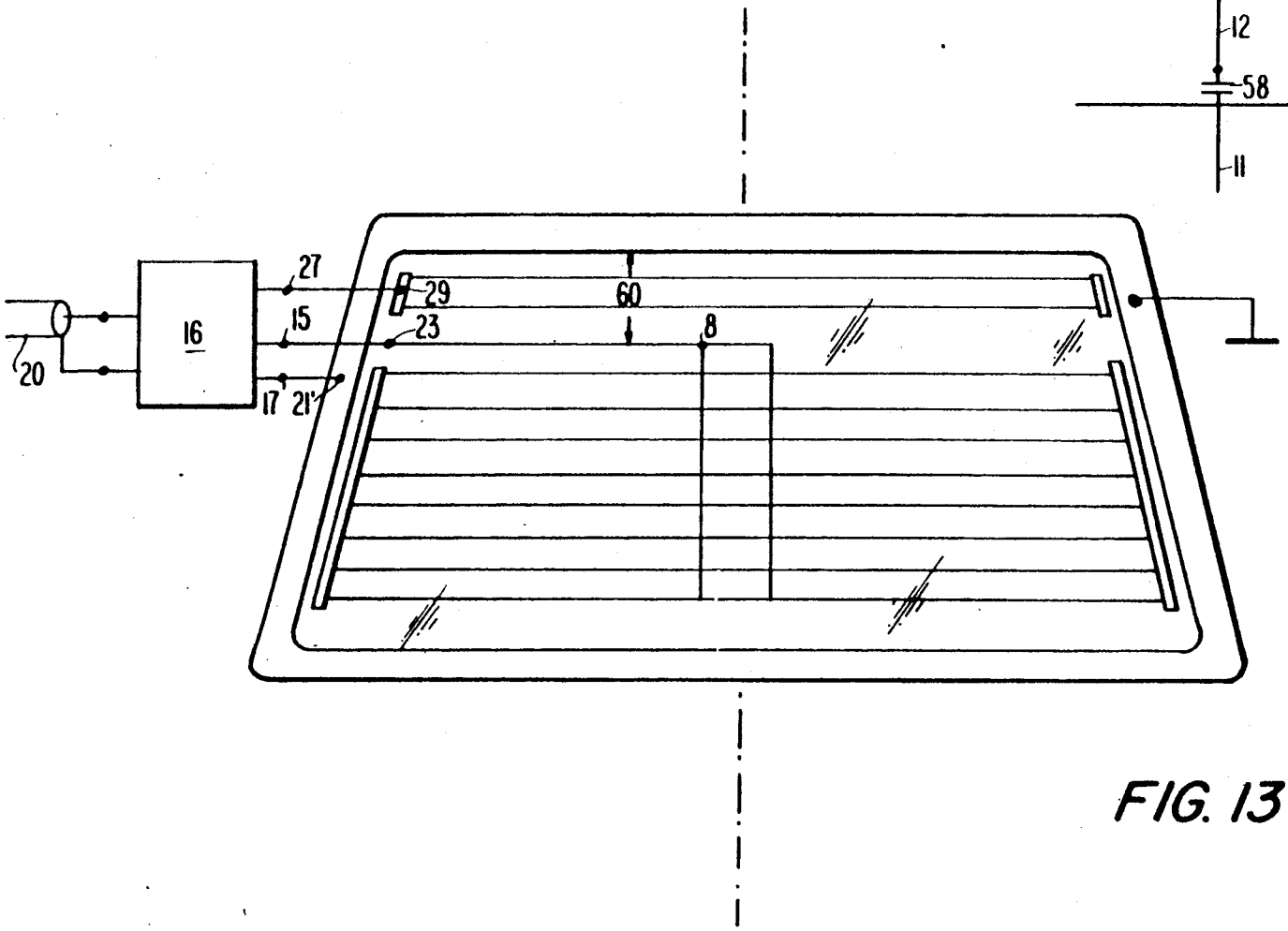
FIG. 13 shows an embodiment of the antenna according to the invention whose common connection conductor is arranged a large distance from the upper side of the metal frame and including separate antenna structure for the reception of long-medium-short waves.

However such a distinct priority for the vertical field components is not always desired because especially in the neighborhood of vertically polarized transmitter stations the requirements with regards the intermodulation resistance at the side of the reception system become too large. Frequently it is desired to provide an antenna which independently of the polarization of the incoming field strength always delivers the same average signal level. This desired action is approximated in the antenna of the invention by directing the connection conductor 22 at a relatively large distance parallel to the upper side of the metal frame inasmuch as in this case the connection conductor 22 has also a strong coupling primarily with a horizontally polarized field. An example of such an antenna is illustrated in FIG. 13.

If an antenna according to the invention is designed for the reception of substantially horizontally polarized waves then the clearance 60 between the connection conductor 22 the upper side of the metal frame can be selected at will.

For diversity antenna systems it is necessary to provide on a single window pane several antennas having widely different properties as regards reception of interferences.

With advantage, two diversity antennas can be designed in accordance with this invention provided that the heating field in motor car window pane is divided.

FIG. 5 shows such an arrangement whereby two connection networks 16 are situated at diagonally opposite points in the proximity of the metal frame. In spite of the regions of the two antennas which being decisive for the reception are located in the range of the vertical line of symmetry of the pane, both antennas have a distinctly different performance.

Figure 14:
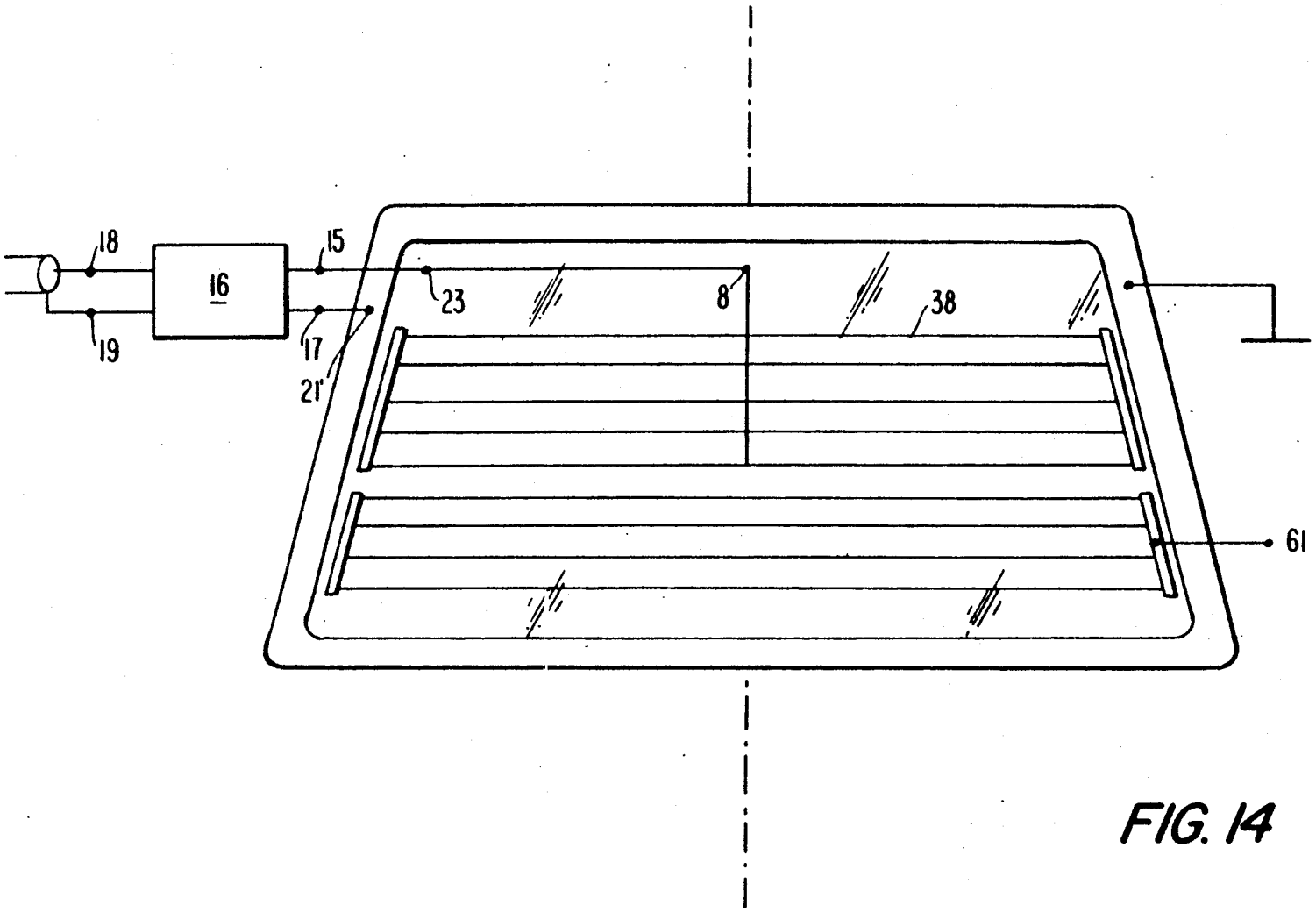
FIG. 14 shows a diversity antenna system including an antenna according to the invention extended by a second antenna provided with a terminal point.

As shown in the example of FIG. 14, when an antenna of this invention is combined with a different type of antenna, the resulting diversity antenna system achieves an improvement in the reception. In this case the second signal is coupled to the collecting bus bar of the divided heating field at the terminal 61 whereby a very good diversity reception quality is obtained.

In a further advantageous embodiment, having the advantage of equal connection networks 16 and exhibiting also a satisfactory diversity reception due to a sufficient decoupling by a relatively large spatial distance between respective antenna conductors 11 and 12, is achieved by the provision of two antennas according to the invention which are distinctly symmetrical relative to the vertical center line 3 of the window pane and being substantially symmetrical relative to one another. Due to the equal configuration of the networks 16 the additional advantages as regards manufacturing, storing and maintenance costs is achieved.

With sufficiently large free space above or below the heating field other diversity antennas can be combined with the antenna of the invention on a single window pane.

As known, it is necessary to make the connection between the terminal point 23 of the antenna of the invention and an input terminal 15 of the connecting network 16 as well as the connection of the other terminal 17 of the network to a ground point 21' on the metal frame as short as possible. The output terminals 18 and 19 of connection network 16 form the connection terminals of the antenna system to which an antenna line is connected. The connection network can be constructed by a known technology exclusively as a passive circuit whose purpose is to match the impedance of the unipole at the coupling point to the wave impedance of the antenna line. Power transmission adjustment by the impedance matching is achieved by suitable low-loss transforming elements.

Advantageously however the connection network 16 for achieving a maximum signal to noise ratio is constructed as an active circuit which together with the antenna of this invention provides an active antenna whose input transistor serves for suppressing noise or noise matching techniques.

If the antenna of the invention is to be employed also as broadcast reception antenna for the frequency range of long, medium and short waves, then in a further advantageous embodiment the window pane is provided with a separate long-medium-short wave antenna structure located in the area of the pane which is outside the heating field and whose terminal point 29 is preferably in the proximity of the terminal point 23 of the antenna of this invention (FIGS. 6 and 13). In this case the connection network 16 is preferably provided with a separate amplifier having a capacitive high impedance input resistance for the frequencies of the long-medium- and short wave lengths and the coupling or terminal point 29 of the LMS antenna structure is connected with the external input network 27 of connection terminal 16. By a known technology for example by a frequency separating circuit the frequency range for the long-medium-short waves and of the meter wavelength range are delivered to the antenna line at the output of the network 16.

Figure 15:
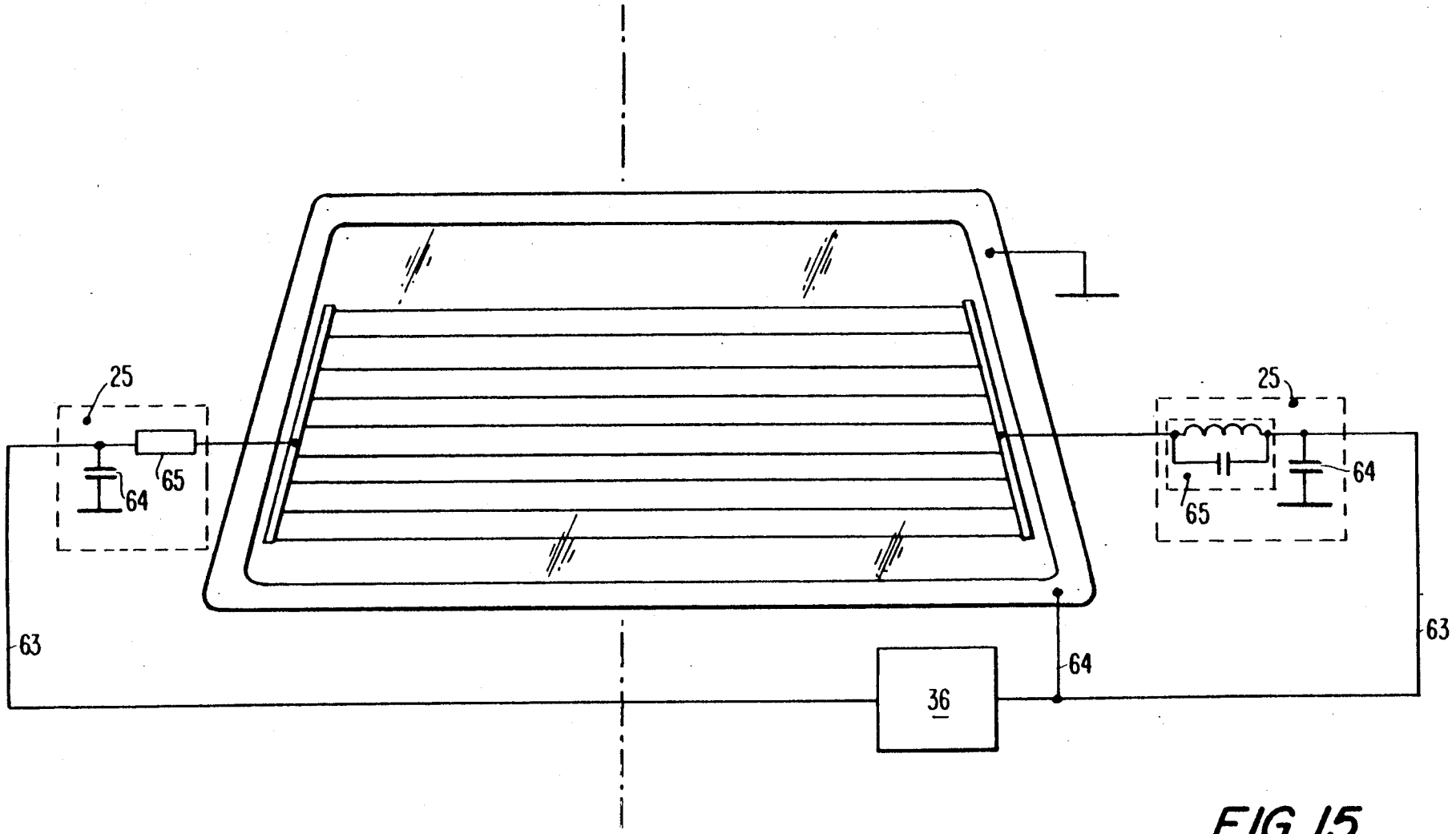
FIG. 15 shows preferred embodiments of networks for the heating field of a window pane.

Collection or bus bars 62 in the proximity of the lateral sides of the window pane by which the heating conductors 2 and 38 are connected, the heating current from battery 36 of the motor vehicle is applied to the heating conductors. As a rule the negative pole of the battery is connected to the motor vehicle body at the connection point 64 (FIG. 15). The energizing circuit of the heating field via direct current feeding conductor 63 leads to undefined alternating current loads of the bus bar 62 for the frequency of the meter wavelength band on the one hand and to coupling of interference signals in the heating field on the other hand because due to the various aggregates of the motor vehicle which draw d.c. from the battery 36, considerable interference signals are superposed to the direct current. The frequency spectrum of the interference signals reaches from low frequencies up to the high frequencies of the meter wavelength band.

Both interfering influences are reduced by the beforedescribed decoupling of the reception zone of the antenna from the marginal ranges of the motor vehicle window pane.

Moreover, in order to optimize the function of the antenna of this invention the interfering influences are avoided by additional measures.

This happens preferably with the aid of interference suppressing networks 25 which are connected in series with the direct current supply conductors 63 in the proximity of the connection points to the collection or bus bars 62 of the heating field.

As illustrated in FIG. 15, the suppression of interference signals superposed to the direct current from the motor vehicle battery 36 is preferably obtained by capacitors 64 connected between the terminals of the battery 36 and the ground. The value of the capacitor 64 is sufficient for providing short circuit for high frequency currents in the meter wavelength range.

In this manner a well defined impedance of the unipole to the terminal point 23 and a well defined connection of the bus bars are obtained.

The capacitive short circuit of the bus bar terminals of the heating field, as measurements have shown, frequently cause an unfavorable influence on the available signal level at the terminal point 23 of the antenna of this invention.

For this reason in a further modification of this invention decoupling circuit 65 is connected in series between a connection point of the capacitor 64 at the respective bus bars 62. For the direct current, the decoupling circuit 65 exhibits only a minor ohmic resistance but for the frequency of the meter wavelength bands it represents a high series impedance which sufficiently reduces the load of the bus bars for the high frequency alternating current. Decoupling circuit 65 can be assembled for example of an air coil of a high inductance and of relatively large wire cross-section to withstand currents between 10A to 30A or by a parallel connection of a smaller air coil and a capacitor. The resulting parallel resonant circuit is dimensioned such that its resonant frequency lies approximately at the center of the meter wavelength band.

It will be understood that each of the elements described above, or two or more together, may also find a useful application in other types of antenna constructions differing from the embodiments described above.

While the invention has been illustrated and described as embodied in specific examples of the motor vehicle window pane antennas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of our contribution to the art.

What is claimed as new and desired to be protected by Letters Patent is set forth in the appended claims:

1. A meter wave band unipole antenna arrangement on a motor vehicle window pane which is mounted in a metal frame and provided with a pane heating field assembled of a plurality of substantially horizontally directed heating conductors, comprising a vertical antenna conductor structure arranged in the area of the vertical plane of symmetry of the window pane, wherein said antenna conductor structure includes two superposed sets of parallel, substantially vertically directed antenna conductors for receiving frequencies of the meter wavelength band; a first set of respective antenna conductors extending in a first region from a marginal heating conductor of the pane heating field across at least two heating conductors; a second set of respective antenna conductors extending from a common connection point in a second region adjoining a marginal heating conductor of the heating field and terminating in the marginal heating conductor; a connection conductor leading from the common connection point to an antenna terminal point located in the second region near the metal frame; and crossing points of the first set of antenna conductors with the assigned heating conductors being interconnected at least for the frequencies of the meter wavelength band.

2. A unipole antenna arrangement as defined in claim 1, wherein the heating conductors and the antenna conductor structure are printed on the upper surface of the window pane.

3. A unipole antenna arrangement as defined in claim 1, wherein the heating conductors and the antenna conductor structure are in the form of wires which are sandwiched between the layers of a multilayer window pane.

4. A unipole antenna arrangement as defined in claim 1, wherein the antenna conductors in the first set are directly connected with corresponding antenna conductors in the superposed second set.

5. A unipole antenna arrangement as defined in claim 1, wherein the ends of the antenna conductors in said second set are interconnected by a common connection conductor passing through said connection point substantially parallel to a horizontal side of the metal frame.

6. A unipole antenna arrangement as defined in claim 5, wherein said common connection conductor extends along the horizontal side of the metal frame.

7. A unipole antenna arrangement as defined in claim 5, wherein said common connection conductor between the ends of the respective antenna conductors in the second set includes coupling capacitors.

8. A unipole antenna arrangement as defined in claim 5, wherein each of the superposed sets includes two parallel antenna conductors spaced apart between 1/10 and 1/30 of a center wavelength in the meter wavelength band and the parallel antenna conductors being symmetrical relative to the vertical line of symmetry of the window pane.

9. A unipole antenna arrangement as defined in claim 1, wherein the connection conductor leading from the connection point extends parallel to the vertical line of symmetry of the window pane up to the proximity of the metal frame and the end of the connection conductor forming the antenna terminal point.

10. A unipole antenna arrangement as defined in claim 1, wherein the connection conductor which leads from the connection point is initially directed parallel to vertical axis of symmetry of the window pane up to the proximity of the metal frame where it is directed substantially parallel to the frame side up to the antenna terminal point.

11. A unipole antenna arrangement as defined in claim 10, wherein a clearance of the connection conductor from a facing side of the metal frame is between 1 cm and 5 cm.

12. A meter wave band unipole antenna arrangement on a motor vehicle window pane which is mounted in a metal frame and provided with a pane heating field assembled of a plurality of substantially horizontally directed heating conductors, comprising a vertical antenna conductor structure arranged in the area of the vertical plane of symmetry of the window pane and including two superposed, substantially vertically directed antenna conductors for receiving frequencies of the meter wavelength band; one of said antenna conductors extending from a marginal conductor of the pane heating field across at least two intermediate heating conductors; the other antenna conductor extending from a connection point in a free region adjoining the marginal heating conductor and terminating in the marginal heating conductor; a connection conductor leading from the connection point to an antenna terminal point located in the free region near the metal frame; and crossing points of the one antenna conductor with the assigned heating conductors being interconnected at least for the frequencies of the meter wavelength band.

13. A unipole antenna arrangement as defined in claim 12, further comprising a second antenna terminal point located on the metal frame and being connected to a grounded point on the metal frame.

14. A unipole antenna arrangement as defined in claim 13, wherein a passive anti-interference circuit is connected to at least one antenna terminal point.

15. A unipole antenna arrangement as defined in claim 13, wherein an antiinterference active circuit is connected to at least one antenna terminal point.

16. A unipole antenna arrangement as defined in claim 12, wherein the heating field is divided into a plurality of separate partial heating fields and the antenna conductor structure is coupled to one of the partial heating fields.

17. A unipole antenna arrangement as defined in claim 16, wherein each of the separate partial heating fields is coupled to an separate antenna conductor structure.

18. A unipole antenna arrangement as defined in claim 12, further comprising a separate along, medium and short wave antenna conductor structure arranged in a free space on the window pane apart from the unipole antenna conductor structure.

* * * * *